US005104564A

United States Patent [19]

Lermond et al.

[11] Patent Number: 5,104,564

[45] Date of Patent: Apr. 14, 1992

[54] HIGH-BOILING HYDROCHLOROFLUOROCARBON SOLVENT BLENDS

[75] Inventors: David S. Lermond; Kenneth T. Dishart; Abid N. Merchant, all of Wilmington, Del.

[73] Assignee: E. I. du Pont de Nemours and Company, Wilmington, Del.

[21] Appl. No.: 452,405

[22] Filed: Dec. 19, 1989

[51] Int. Cl.[5] ..... C23G 5/028; C11D 7/50

[52] U.S. Cl. ..... 252/170; 252/162; 252/172; 252/364; 252/79

[58] Field of Search ..... 252/364, 162, 170, 79

[56] References Cited

U.S. PATENT DOCUMENTS 3,183,192 5/1965 Bauer ..... 252/364
3,692,635 9/1972 Fozzard ..... 203/62

FOREIGN PATENT DOCUMENTS 0062516 10/1982 European Pat. Off. .
40185 3/1985 Japan .
40186 3/1985 Japan .
40187 3/1985 Japan .
108490 6/1985 Japan .
2188059 9/1987 United Kingdom .

*Primary Examiner*—Paul Lieberman
*Assistant Examiner*—J. Darland
*Attorney, Agent, or Firm*—Robert B. Stevenson

[57] ABSTRACT

A high-boiling hydrochlorofluorofluorocarbon (HCFC) solvent comprising a blend of for every 100 parts by weight of a hydrochlorofluorocarbon (e.g., 1,1,1-trifluorodichloroethane or 1,1-dichloro-1-fluoroethane) from about 25 to about 400 parts by weight of a selected organic solvent (e.g., dipropylene glycol monomethyl ether, dipropylene glycol monomethyl ether acetate, or mixture of dimethyladipate, dimethylglutarate, and dimethylsuccinate). Such solvents are useful in liquid/vapor phase cleaning applications even at elevated temperatures above the boiling temperature predicted by Raoult's law.

28 Claims, No Drawings

HIGH-BOILING HYDROCHLOROFLUOROCARBON SOLVENT BLENDS

BACKGROUND OF THE INVENTION

1. Field of the Invention

This invention relates to high-boiling hydrochlorofluorocarbon (HCFC) solvents and a novel method of using the same in cleaning applications. More specifically, the invention relates to admixtures of hydrochlorofluorocarbons and selected organic solvents that exhibit a vapor pressure significantly lower than predicted by Raoult's law for ideal mixtures and their use at elevated temperature in liquid/vapor phase cleaning applications.

2. Description of the Related Art

It is generally known that during the manufacture of machinery parts, household utensils, tools, electronic components, and many other products, one of the more important steps is the cleaning of the finished parts. Oil, grease, contaminants from soldering processes such as flux residues, solid buffing compounds adhering to the manufactured items, and the like must be removed before sale or use. Modern electronic instruments and control devices, for example, require cleanliness of their parts to an unprecedented degree.

For convenience and effectiveness, removal of contaminants from manufactured items, particularly metal items, is done by rinsing in an organic solvent. Generally the cleaning process involves immersing the item to be cleaned in a solvent, often a heated solvent, for a period of time, followed by immersion in a clean solvent or in the vapor of the clean solvent. The cleaning solvent may contain additives such as detergents to enhance the cleaning action of the solvent.

Hydrocarbon solvents have been and are being used in cleaning processes because of their effectiveness in removing oil and grease residues and their low cost. However hydrocarbon solvents are generally very flammable, often incompatible with polymeric substrates, and are often toxic. Chlorinated hydrocarbon solvents have been used to reduce flammability, but in general they are more toxic than the hydrocarbon solvents. Chlorofluorocarbons, such as for example, 1,1,2-trichloro-1,2,2-trifluoroethane (CFC-113), because of their greatly reduced toxicity and their non-flammability, have found acceptance as good organic solvents for the many cleaning processes. Popularity of CFC-113 as the cleaning solvent is due to its many desirable characteristics in addition to the above-mentioned non-flammability and greatly reduced toxicity, such as convenient and useful boiling point of about 48° C., which allows enhanced cleaning at a convenient operating temperature and easy purification and recovery for recycle, its compatibility with most organic polymeric materials and metals, its solvency characteristics, and its very high degree of inertness, i.e. stability.

However, in recent years, the outstanding stability of the fully halogenated chlorofluorocarbons (CFCs), which includes CFC-113, has been cited as contributing to their role in the depletion of the stratospheric ozone layer. It has been suggested that the stability of the CFCs is such that, when released into the atmosphere, ultimately some will reach the stratosphere unchanged and by ultra-violet-promoted decomposition may participate in the ozone-depletion process. Consequently, it is now generally recognized that there is a need to develop alternatives to CFCs which have no or very little effect upon the ozone-depletion process.

SUMMARY OF THE INVENTION

The present invention provides novel blends of hydrogen-containing chlorofluorocarbons (i.e., so called hydrochlorofluorocarbons, HCFCs) and organic solvents characterized by the fact that the observed vapor pressure of the more volatile hydrogen-containing chlorofluorocarbon component in the liquid-phase mixture is significantly lower than what is predicted by Raoult's law for an ideal mixture. Consequently, the novel blends are particularly useful as cleaning agents at temperatures higher than normally employed for the particular hydrogen-containing chlorofluorocarbon, including temperatures above the boiling temperature predicted by Raoult's law for an ideal mixture. As such, both the solvent's dissolving capacity and the kinetics of the dissolving are usually improved, while the ability to readily condense pure HCFC vapor over the relatively hot liquid-phase cleaning solution makes the compositions according to the present invention particularly useful in contemporary liquid/vapor phase cleaning and rinsing systems and equipment.

According to the present invention, a solvent composition comprising from about 20 to about 80 weight percent hydrogen-containing chlorofluoroethane (for example but not by way of limitation, 1,1,1-trifluorodichloroethane and 1,1-dichloro-1-fluoroethane) and from 80 to 20 weight percent of at least one of dipropylene glycol monoalkyl ether or organic acid ester thereof or dialkyl ester of a dicarboxylic acid and mixtures thereof (again for example but not by way of limitation, dipropylene glycol monomethyl ether, dipropylene glycol monomethyl ether acetate and mixed dimethyl esters of succinic, glutaric and adipic acids) is to be employed.

Thus the present invention provides a composition comprising a blend of a cosolvent and a hydrogen-containing chlorofluorocarbon which exhibits an affinity for the cosolvent, wherein for every 100 parts by weight of the hydrogen-containing chlorofluorocarbon there is present from about 25 parts by weight to about 400 parts by weight of the cosolvent selected from the group consisting of:

(a) $C_1$ to $C_6$ mono or di alkyl ethers of dipropylene glycol;

(b) $C_1$ to $C_6$ esters of dipropylene glycol mono alkyl ethers;

(c) diesters of $C_4$ to $C_6$ organic dicarboxylic acids; and (e) mixtures thereof.

It is therefore an object of the present invention to provide an effective solvent system useful in the solvent cleaning processes which has little or no effect on stratospheric ozone depletion. It is a further object to provide such a solvent that will be effective at elevated temperatures. Fulfillment of these objects and the presence and fulfillment of other objects will be apparent upon complete reading of the specification and attached claims.

DESCRIPTION OF THE PREFERRED EMBODIMENTS

It is now believed that the key to reducing or eliminating the ozone depleting potential of a chlorofluorocarbon is a matter of reducing the long term stability of the compound in the atmosphere; i.e., making the compound more degradable. If its stability is such that all or substantially all of the chlorofluorocarbon is decomposed in the atmosphere prior to reaching the stratosphere, no chlorofluorocarbon will survive to participate in the ozone depletion process.

As early as the 1970s with the initial emergence of the ozone depletion theory, it was known that the introduction of hydrogen into previously fully halogenated chlorofluorocarbons markedly reduced the chemical stability of these compounds. Hence, these now destabilized compounds would be expected to degrade in the atmosphere and not reach the stratosphere and the ozone layer. The accompanying table lists the ozone depletion potential for a variety of fully and partially halogenated halocarbons. Halocarbon Global Warning Potential data (potential for reflecting infrared radiation (heat) back to the earth and thereby raising the earth's surface temperature) are also shown.

OZONE DEPLETION AND GREENHOUSE POTENTIALS

| Compound | Ozone Depletion Potential | Halocarbon Global Warning Potential* |
|---|---|---|
| CFC-11 ($CFCl_3$) | 1.0 | 1.0 |
| CFC-12 ($CF_2Cl_2$) | 1.0 | 2.8 |
| HCFC-22 ($CHF_2Cl$) | 0.05 | 0.34 |
| HCFC-123 ($CF_3CHCl_2$) | 0.02 | 0.017 |
| HCFC-141b ($CFCl_2CH_3$) | 0.1 | 0.087 |
| CFC-113 ($CF_2ClCFCl_2$) | 0.8 | 1.4 |

*Du Pont calculated.

Halocarbons such as HCFC-123 and HCFC-141b are environmentally acceptable in that they theoretically have minimal effect on ozone depletion. When compared to the commercially used CFC-113, these hydrogen-containing chlorofluorocarbons, HCFC-123 and HCFC-141b, exhibit most of the desirable characteristics necessary in the solvent cleaning processes except for their lower than desirable boiling points. Thus, in contrast to CFC-113 which boils at about 48° C., HCFC-123 boils at about 29° C. and HCFC-141b boils at about 32° C. As generally recognized, the efficiency of removal of contaminants by solvents is usually enhanced, both in terms of ultimate solubility and kinetics, with increasing temperatures.

It has now been found that the temperature at which boiling will occur for solvent blends according to the present invention can be raised considerably relative to the boiling point of the pure HCFC by adding to the HCFC a selected second liquid phase, herein referred to as a cosolvent. Because the onset of boiling will occur at a higher temperature, the compositions according to the present invention will be operative as cleaning solvents at higher temperatures.

The cosolvents used in combination with the HCFC to form the solvent blends according to the present invention are characterized as being a higher boiling organic liquid phase that has an affinity for the HCFC over a broad range of concentrations, yet they do not form azeotropes with the HCFC. As such, the boiling process referred to herein involves predominantly the vaporization of the lower boiling HCFC (albeit, at an unexpectedly high temperature relative to the boiling point of the pure HCFC) with an associated diminishing of the concentration of HCFC in the boiling solvent blend phase.

Thus according to the present invention, when the HCFC is either 1,1,1-trifluorodichloroethane or 1,1-dichloro-1-fluoroethane, the observed boiling temperature can be raised considerably relative to their respective boiling points by adding either dipropylene glycol monomethyl ether, dipropylene glycol monomethyl-ether acetate or a mixture of dimethyl esters of 4 to 6 carbon atom dibasic acids. For example and as illustrated later, a solvent mixture containing 30 weight percent of 1,1,1-trifluorodichloroethane which boils at 28.7° C. and 70 weight percent of dipropylene glycol monomethyl ether was found to boil at 88° C. under atmospheric conditions. A similar blend containing 70 weight percent of dipropylene glycol monomethyl ether acetate was found to boil at 93° C. and a blend containing 70 weight percent of mixed dimethylesters of succinic, glutaric and adipic acids was found to boil at 81° C. A solvent composition containing 30 weight percent of 1,1-dichloro-1-fluoroethane which boils at 32° C. and 70 weight percent of mixed dimethyl esters of succinic, glutaric and adipic acid was found to boil at 67° C.

While the present invention is not bound by any particular theory or explanation, it is postulated that some physical/chemical interaction occurs between the hydrogen-containing chlorofluorocarbons of the present invention and the above-described dibasic esters, dipropylene glycol monomethyl ether and dipropylene glycol monomethyl ether acetate, an effect of such interaction being that the boiling temperature of the compositions are considerably higher than expected (i.e., higher than the boiling point predicted by Raoult's law). An indication that such an interaction occurs can be seen in heat of mixing experiments. Thus, when 100 grams of 1,1,1-trifluorodichloroethane (HCFC-123) is mixed with 100 grams of above-described mixed dimethylesters of succinic, glutaric and adipic acids under adiabatic conditions, a temperature rise of of the order of 7.9° C. is observed. In contrast thereto, when a chlorofluorocarbon which does not contain a hydrogen substituent, such as 1,1,2-trichloro-1,2,2-trifluoroethane (CFC-113), is mixed with the same mixed esters under the same conditions, a temperature drop of about 2.5° C. is observed.

The significance of the present discovery is that a solvent system, for example, that containing 1,1,1-trifluorodichloroethane can now be used in a cleaning process at a temperature of about 80° C. instead of being limited to about 29° C. under atmospheric conditions. The use at high temperatures provides more effective cleaning and at much shorter processing times with such solvents as 1,1,1-trifluorodichloroethane and 1,1-dichloro-1-fluoroethane. Furthermore, since the vapor above the boiling mixture of the present invention is primarily either 1,1,1-trifluorodichloroethane or 1,1-dichloro-1-fluoroethane, by using a conventional vapor degreaser in which the condensate from the condenser is returned to one or more rinse sumps cascading one into the other and finally into the boiling sump, the article cleaned in the boiling sump containing the mixture of the present invention can be rinsed to remove any of the high boiling cosolvents (i.e., the other components of the blend) on the surface of the article by immersion into one or several rinse sumps and then suspending it in the vapor space where the rinsing action of the condensing vapor will provide a final pure rinse.

The compositions of the instant invention can be prepared by any of the convenient methods generally known in the art. Usually the desired components are simply mixed together in desired proportions. The components of the invention being mutually soluble, very little mixing is required.

The chlorofluorocarbons useful in the present invention are generally any hydrogen-containing chlorofluorocarbon that exhibits an affinity for the cosolvent over a broad range of relative concentrations. For purposes of this invention, an affinity for the cosolvent is to be viewed as any interaction which results in a raising of the boiling temperature of the blend or mixture relative to the boiling point which would be expected for an ideal solution of the HCFC and cosolvent, as illustrated in the Examples later. In other words the HCFC useful in the present invention is any hydrogen-containing chlorofluorocarbon that when mixed with the selected cosolvent exhibits a vapor pressure for the HCFC significantly lower than that predicted by Raoult's law for ideal mixtures. Again without unduly restricting the scope of the invention, this desired interaction is viewed as being associated with the presence of the hydrogen atom in the chlorofluorocarbon. Thus any hydrochlorofluorocarbon as opposed to the perhalogenated compounds are viewed as being operative for purposes of this invention. This would include by way of example but not limited thereto, any $C_1$ to $C_4$ hydrochlorofluoro alkane and in particular hydrochlorofluoroethanes that exhibit the desired vapor pressure lowering relative to that predicted by Raoult's law. In the case of hydrochlorofluoroethanes the vapor pressure lowering is observed to small degree in 1,1-dichloro-1-fluoroethane and to a much greater extent in 1,1,1-trifluorodichloroethane, as such 1,1,1-trifluoro-dichloroethane is the most preferred HCFC for purposes of this invention.

The cosolvent or other liquid organic component to which the HCFC is added in order to make the high-boiling solvent blend according to the present invention is selected from the group consisting of a dipropylene glycol monoalkyl ether or an ester of a dipropylene glycol monoalkyl ether, wherein the alkyl group and the ester group are $C_1$ to $C_6$ aliphatic radicals, and the dialkyl esters of $C_4$ to $C_6$ dicarboxylic acids, wherein the dialkyl groups are $C_1$ to $C_6$ radicals. It should be appreciated that mixtures of the respective cosolvents can also be used such as a mixture of dibasic esters produced as a by-product of adipic acid manufacture described more fully later. In principle, mixtures of the HCFC's can also be employed particularly azeotropic mixtures.

The relative amount of the HCFC and cosolvent to be used in the present invention can vary over a broad range, particularly since the HCFC and cosolvent are miscible. As such, an effective amount of HCFC in the cosolvent can be as little as a few percent in that the lowering of the vapor pressure is present at these low concentrations and extends to as high as a few percent cosolvent. The novel compositions of the present invention will typically have from about 20 to about 80 weight percent of a hydrogen-containing chlorofluoroethane and from about 80 to 20 weight percent of a second liquid cosolvent of either a dipropylene glycol monoalkyl ether, an ester of a dipropylene glycol monoalkyl ether or one or more dialkyl esters of a dicarboxylic acid, such as succinic, glutaric and adipic acids. A preferred composition will contain 1,1,1-trifluorodichloroethane or 1,1-dichloro-1-fluoroethane as hydrogen-containing chlorofluoroethane. A more preferred composition will contain from about 20 to about 50 weight percent of 1,1,1-trifluoroethane or 1,1-dichloro-1-fluoroethane and from about 50 to about 80 weight percent of at least one of dipropylene glycol monomethyl ether, dipropylene glycol monomethyl ether acetate and mixed dimethyl esters of dibasic acids comprising from about 15 to about 20 weight percent of dimethyladipate, about 60 to about 70 weight percent of dimethylgluterate and about 15 to 20 weight percent of dimethylsuccinate. An even more preferred composition will contain from about 25 to about 35 weight percent of 1,1,1-trifluorodichloroethane or 1,1-dichloro-1-fluoroethane and from about 75 to about 65 weight percent of mixed dimethyl ester comprising from about 15 to about 20 weight percent dimethyladipate, about 60 to about 70 weight percent dimethylgluterate and from about 15 to 20 weight percent dimethylsuccinate. A mixture of hydrogen-containing chlorofluorocarbons as well as a mixture of above-described cosolvents may also be used in the present invention.

The following examples are presented to further illustrate specific embodiments of the present invention including the measurement of properties considered significant in understanding and explaining the unexpected behavior of the compositions as well as demonstrating the utility of the compositions. In these examples all reference to parts and percentages are by weight unless otherwise indicated and the HCFC-123 used was from commercial sources that typically include up to 10 percent of the HCFC-123a isomer.

EXAMPLE 1

Heat of mixing experiments were carried out by adding 100 grams of 1,1,1-trifluorodichloroethane (HCFC-123) with stirring to 100 g of a dibasic ester composition (DBE) in a dewar flask equipped with a thermometer. The DBE was a mixture of dibasic esters sold by the Du Pont Co. having a nominal composition of 17 weight percent dimethyladipate, 66 weight percent dimethylgluterate and 16.5 weight percent dimethylsuccinate along with trace amounts of methanol (typically 0.2 weight percent) and water (less than 0.1 weight percent). For comparison purposes, identical experiments were carried out substituting a non-hydrogen-containing chlorofluorocarbon, 1,1,2-trichloro-1,2,2-trifluoroethane (CFC-113) for HCFC-123. The results are summarized in Table I.

TABLE I

| | | Heat of Mixing | | |
|---|---|---|---|---|
| | | Initial Temp., °C. | Final Temp., °C. | Temp. Change, °C. |
| I. | HCFC-123/DBE | | | |
| | 1. | 21.2 | 29.4 | +8.2 |
| | 2. | 21.6 | 29.7 | +8.1 |
| | 3. | 21.9 | 29.3 | +7.4 |
| | | | | Average +7.9 |
| II. | CFC-113/DBE | | | |
| | 1. | 21.4 | 18.3 | −3.1 |
| | 2. | 21.3 | 19.0 | −2.3 |
| | 3. | 21.3 | 19.2 | −2.1 |
| | | | | Average −2.5 |

The above results clearly show interaction (i.e., an exothermic heat of mixing) between the hydrogen-containing chlorofluorocarbon (HCFC-123) and the dibasic ester (DBE) compositions whereas no such effects (i.e., an endothermic heat of mixing) are noted with chlorofluorocarbon which does not contain a hydrogen substituent (CFC-113).

EXAMPLE 2

Atmospheric boiling temperatures of compositions containing 30 weight percent 1,1,1-trifluoro-dichloroethane (HCFC-123) b.p. 28.7° C. and 1,1-dichloro-1-fluoroethane (HCFC-141b) b.p. 32° C. and 70 weight percent of either dipropylene glycol monomethyl ether (DPM), dipropylene glycol monomethyl ether acetate (DPMA) or the dibasic ester (DBE) described in Example 1 were measured. The resulting data are presented in Table II.

TABLE II

| HCFC | Cosolvent | Boiling Temperatures, °C. of HCFC/Cosolvent Observed | Predicted |
|---|---|---|---|
| 123 | DBE | 81 | 64 |
| 123 | DPM[1] | 88 | 67 |
| 123 | DPMA[2] | 93 | 60 |
| 141b | DBE | 67 | 64 |

[1]Dipropylene glycol monomethyl ether supplied by Arco Chemical Co. under the tradename "ARCOSOLV" DPM.
[2]Dipropylene glycol monomethyl ether acetate supplied by Arco Chemical Co. under the tradename "ARCOSOLV" DPMA.

From the above boiling temperature data, it can be seen that the use temperature of HCFC-123 has been raised more than 50° C. and that of HCFC-141b has been raised 35° C.

EXAMPLE 3

One of the areas in which solvent cleaning of finished articles is used is in cleaning small articles. For example, solid brass lamp finials which are used to hold lamp shades in place are generally polished after manufacture and thus buffing compounds used must be removed. In order to demonstrate and evaluate the performance of compositions according to the present invention in such an application, two buffing compounds, iron oxide rouge and amorphous silica, were rubbed on to 1¾ inch long solid brass lamp finials. The polished finials were then immersed for 30 seconds in a 30/70 blend of HCFC-123 and DBE at 80° C. For comparison purposes, some of the polished finials were immersed in boiling HCFC-123 (boiling point 28.7° C.). The cleaned finials were then rated visually using a 0 to 4 scale with 4 representing no visible residue. The results are presented in Table III.

TABLE III

| BUFFING COMPOUND REMOVAL | | |
|---|---|---|
| Cleaning Solvent | Buffing Compound | Rating |
| HCFC-123 | Iron Oxide Rouge | <1 |
| HCFC-123/DBE | Iron Oxide Rouge | 3 |
| HCFC-123 | Amorphous Silica | 2 |
| HCFC-123/DBE | Amorphous Silica | 3 |

The above results show that HCFC-123 alone is virtually ineffective in removing the iron oxide rouge buffing composition particularly when compared to the HCFC-123/DBE composition according to the present invention. With amorphous silica buffing composition, HCFC alone will remove some of the buffing composition but the composition of the present invention is clearly superior.

EXAMPLE 4

In order to demonstrate the effectiveness of the compositions according to the present invention in removing heavy grease, bearings having 1½ inch outside diameter and containing 24 steel balls 7/32 inch in diameter held between two races were packed lightly with 1 to 1.2 grams of grease (Shell Alvania Grease No. 2). The bearings were then suspended in boiling cleaning composition in 4-liter beakers equipped with condensing coils. After each cleaning time increment, the bearing was dried in a vacuum oven at 132° C. Weight loss of pure grease under these drying conditions (i.e., without being suspended in boiling cleaning composition) was found to be insignificant. A 30/70 blend of HCFC-123/DBE and for comparison purposes HCFC-123 alone and CFC-113 alone were used in the grease removal tests. The results are presented in Table IV.

TABLE IV

| Solvent | Grease Removal Immersion Time (min.) | Percent Grease Remaining |
|---|---|---|
| CFC-113 | 15 | 38 |
| | 25 | 8.3 |
| HCFC-123 | 15 | 32 |
| | 25 | 4.7 |
| HCFC-123/DBE | 15 | 17 |
| (30/70) | 25 | 1.8 |

The above results clearly show superior grease removal by the compositions according to the present invention.

EXAMPLE 5

Commercially available chlorofluorocarbon solvents are generally ineffective in removing high melting waxes such as Carnauba wax from surfaces. With this in mind, stainless steel coupons (2⅜"×¼"×1/16") were coated with wax by dipping in melted Carnauba wax (m.p. 82° C., Fisher Scientific Co.). The coated coupons were then suspended in various cleaning compositions in a beaker equipped with condensing coils. After each time increment the coupons were removed from the beaker, dipped in 1,1,2-trichloro-1,2,2-trifluoroethane (CFC-113), to rinse off any DBE remaining on the cleaned coupon, dried, and weighed. A 30/70 blend of HCFC-123/DBE at 78° C., representative of a composition according to the present invention, and for comparison the same blend at 50° C. were used as cleaning compositions. After two-minute suspension times in the beaker of cleaning solution, the coupon in HCFC-123/DBE at 78° C. showed about 98% wax removal and the coupon in HCFC-123/DBE at 50 C. showed only 2% wax removal. This example shows the importance of temperature in promoting wax removal and demonstrates that, when used in the compositions of the present invention, HCFC-123 can be used at a temperature high enough for the removal of high melting wax.

EXAMPLE 6

In order to demonstrate the cleaning of electronic circuit boards using the compositions of the present invention, several single sided circuit boards were coated with soldering flux (Kester 1585) and soldered by preheating to about 600° F. (316° C.) and then passed through a molten solder wave at a conveyor speed of 2 feet per minute. Cleaning of the soldered circuit boards was done in a 4-gallon, two sump open top Lenape degreaser. A 40/60 blend of HCFC-123/DBE according to the present invention was charged to the boil sump and HCFC-123 was charged to the rinse sump. The degreaser was operated with HCFC-123/DBE blend at boil (57° C.) with the condenser coils cooled by water at 3°–4° C. The circuit board to be cleaned was immersed in the boiling HCFC-123/DBE bath for two minutes and then in HCFC-123 bath for two minutes and then in vapor space over boiling HCFC-123 for 30 seconds. The boards were essentially clean with very small amounts of white residue remaining and were considerably cleaner than when cleaned using only HCFC-123 in both sumps.

Having thus described and exemplified the invention with a certain degree of particularity, it should be appreciated that the following claims are not to be so limited but are to be afforded a scope commensurate with the wording of each element of the claim and equivalents thereof.

We claim:

1. A composition comprising a liquid blend of a liquid cosolvent and a liquid hydrogen-containing chlorofluorocarbon which exhibits an affinity for said cosolvent, wherein for every 100 parts by weight of said hydrogen-containing chlorofluorocarbon there is present from about 25 parts by weight to about 400 parts by weight of said cosolvent selected from the group consisting of:

(a) $C_1$ to $C_6$ mono or di alkyl ethers of dipropylene glycol;

(b) $C_1$ to $C_6$ esters of dipropylene glycol mono alkyl ethers;

(c) $C_1$ to $C_6$ diesters of $C_4$ to $C_6$ organic dicarboxylic acids; and (e) mixtures thereof.

2. The composition of claim 1 wherein said cosolvent is selected from the group consisting of:

(a) dipropylene glycol monomethyl ether;

(b) dipropylene glycol monomethyl ether acetate; and (c) a mixture of dimethyladipate, dimethylgluterate, and dimethylsuccinate.

3. The composition of claim 1 or 2 wherein said hydrogen-containing chlorofluorocarbon is 1,1,1-trifluorodichloroethane or 1,1-dichloro-1-fluoroethane.

4. The composition of claim 2 wherein said cosolvent is a mixture comprising from about 15 to about 20 weight percent dimethyladipate, from about 60 to about 70 weight percent dimethylglutarate and from about 15 to about 20 weight percent dimethylsuccinate.

5. The composition of claim 3 wherein said cosolvent is a mixture comprising from about 15 to about 20 weight percent dimethyladipate, from about 60 to about 70 weight percent dimethylglutarate and from about 15 to about 20 weight percent dimethylsuccinate.

6. The composition of claim 5 wherein said hydrogen-containing chlorofluoroethane is 1,1,1-trifluorodichloroethane.

7. The composition of claim 5 wherein said hydrogen-containing chlorofluoroethane is 1,1-dichloro-1-fluoroethane.

8. The composition of claim 2 or 4 wherein for every 100 parts by weight of said hydrogen-containing chlorofluoroethane there is from about 100 to about 400 parts by weight of said cosolvent.

9. The composition of claim 3 wherein for every 100 parts by weight of said hydrogen-containing chlorofluoroethane there is from about 100 to about 400 parts by weight of said cosolvent.

10. The composition of claim 6 wherein for every 100 parts by weight of said hydrogen-containing chlorofluoroethane there is from about 100 to about 400 parts by weight of said cosolvent.

11. The composition of claim 7 wherein for every 100 parts by weight of said hydrogen-containing chlorofluoroethane there is from about 100 to about 400 parts by weight of said cosolvent.

12. A high-boiling cleaning solvent comprising:

(a) from about 80 to about 20 weight percent of a liquid phase organic solvent selected from the group consisting of;

(i) dipropylene glycol mono and di alkyl ethers, (ii) esters of a dipropylene glycol mono alkyl ether, (iii) $C_1$–$C_6$ diesters of $C_4$ to $C_6$ dicarboxylic acids, and (iv) mixtures thereof; and (b) from about 20 to about 80 weight percent of a hydrogen-containing chlorofluorocarbon to produce a blend wherein said liquid phase organic solvent and hydrogen-containing chlorofluorocarbon mixture boils at a temperature above the boiling temperature predicted by Raoult's law.

13. The composition of claim 12 wherein said liquid is selected from the group consisting of:

(a) dipropylene glycol monomethyl ether;

(b) dipropylene glycol monomethyl ether acetate; and (c) a mixture of dimethyladipate, dimethylgluterate, and dimethylsuccinate.

14. The composition of claim 12 or 13 wherein said hydrogen-containing chlorofluorocarbon is 1,1,1-trifluorodichloroethane or 1,1-dichloro-1-fluoroethane.

15. The composition of claim 13 wherein said liquid is a mixture comprising from about 15 to about 20 weight percent dimethyladipate, from about 60 to about 70 weight percent dimethylglutarate and from about 15 to about 20 weight percent dimethylsuccinate.

16. The composition of claim 14 wherein said liquid is a mixture comprising from about 15 to about 20 weight percent dimethyladipate, from about 60 to about 70 weight percent dimethylglutarate and from about 15 to about 20 weight percent dimethylsuccinate.

17. The composition of claim 16 wherein said hydrogen-containing chlorofluorocarbon is 1,1,1-trifluorodichloroethane.

18. The composition of claim 16 wherein said hydrogen-containing chlorofluorocarbon is 1,1-dichloro-1-fluoroethane.

19. The composition of claim 13 or 15 wherein for every 100 parts by weight of said hydrogen-containing chlorofluorocarbon there is from about 100 to about 400 parts by weight of said liquid.

20. The composition of claim 14 wherein for every 100 parts by weight of said hydrogen-containing chlorofluorocarbon there is from about 100 to about 400 parts by weight of said liquid.

21. The composition of claim 17 wherein for every 100 parts by weight of said hydrogen-containing chlorofluorocarbon there is from about 100 to about 400 parts by weight of said liquid.

22. The composition of claim 18 wherein for every 100 parts by weight of said hydrogen-containing chlorofluorocarbon there is from about 100 to about 400 parts by weight of said liquid.

23. A cleaning solvent composition comprising:

(a) from about 80 to about 20 weight percent of a liquid cosolvent selected from the group consisting of:

(i) a dipropylene glycol monoalkyl ether, (ii) an ester of a dipropylene monoalkyl ether, and (iii) one or more $C_1$ to $C_6$ diesters of $C_4$ to $C_6$ dicarboxylic acids; and (b) from about 20 to about 80 weight percent of a hydrogen-containing chlorofluoroethane, wherein said hydrogen-containing chlorofluoroethane exhibits an affinity for said liquid cosolvent.

24. A composition of claim 23 wherein said hydrogen-containing chlorofluoroethane is either 1,1,1-trifluoro-1-chloroethane or 1,1-dichloro-1-fluoroethane.

25. A composition of claim 24 wherein said hydrogen-containing chlorofluoroethane is present in about 20 to about 50 weight percent.

26. A composition of claim 25 wherein said liquid cosolvent comprises a mixture of from about 15 to about 20 weight percent dimethyladipate, from about 60 to about 70 weight percent dimethylgluterate, and from about 15 to about 20 weight percent dimethylsuccinate.

27. A composition of claim 26 wherein said hydrogen-containing chlorofluoroethane is present in about 25 to about 35 weight percent.

28. A method of cleaning a dirty article comprising the steps of:

(a) immersing said dirty article in a high-boiling cleaning solvent comprising, a liquid cosolvent and an effective amount of a liquid hydrogen-containing chlorofluorocarbon which exhibits an affinity for said cosolvent such as to produce a blend that boils at a temperature above the boiling temperature predicted by Raoult's law, at a temperature above the boiling temperature predicted by Raoult's law for said blend for a sufficient time to clean said article; and (b) recovering a clean article.

* * * * *